United States Patent [19]

Wall

[11] Patent Number: 4,930,699

[45] Date of Patent: Jun. 5, 1990

[54] COMBINED HAND SPRAY AND MASSAGER

[76] Inventor: Richard Wall, 18808 Hurdt Rd., Glencoe, Mo. 63038

[21] Appl. No.: 341,959

[22] Filed: Apr. 24, 1989

[51] Int. Cl.[5] ..... B05B 3/16

[52] U.S. Cl. ..... 239/102.1; 239/242; 239/381

[58] Field of Search ..... 239/102.1, 236, 242, 239/246, 381, 239, 240, 263, 237, 249, 214.13

[56] References Cited

U.S. PATENT DOCUMENTS

| | | | |
|---|---|---|---|
| D. 245,093 | 7/1977 | Saether | D23/223 |
| D. 288,228 | 2/1987 | Shames et al. | D23/226 |
| D. 291,114 | 7/1987 | Piesco | D23/223 |
| 1,146,662 | 7/1915 | Staab | 4/615 |
| 2,200,503 | 5/1940 | Judell et al. | 239/588 |
| 2,315,153 | 3/1943 | Ellinger | 4/517 |
| 2,344,150 | 3/1944 | Judell | 137/603 |
| 3,882,864 | 5/1975 | Montgomery | 4/517 |
| 3,929,287 | 12/1975 | Givler et al. | 239/381 |
| 4,026,470 | 5/1977 | Crist | 239/381 |
| 4,068,801 | 1/1978 | Leutheuser | 239/381 |
| 4,350,158 | 9/1982 | Hudson | 239/381 |

FOREIGN PATENT DOCUMENTS

| | | | |
|---|---|---|---|
| 1490836 | 11/1977 | United Kingdom | 239/381 |
| 2063714 | 6/1981 | United Kingdom | 239/237 |

*Primary Examiner*—Andres Kashnikow
*Assistant Examiner*—Karen B. Merritt
*Attorney, Agent, or Firm*—Andsel Group

[57] ABSTRACT

A hand held water spray and massage fixture attachable to a standard sink faucet by means of a flexible hose. The vibrating face of the fixture is driven by an enclosed water turbine rotated by spray water flow over the turbine blades. A crank shaft on the turbine wheel is coupled to the movable face of the fixture.

1 Claim, 1 Drawing Sheet

COMBINED HAND SPRAY AND MASSAGER

BACKGROUND OF THE INVENTION

1. Field of the Invention

The present invention relates to hand held spray fixtures that couple to standard sink water faucets by means of a flexible hose.

2. Description of the Prior Art

Plumbing fixtures having a flexible hose coupled hand held spray dispenser are old in the art. U.S. Pat. No. 2,315,153 Ellinger, describes a flexible hose coupled to the standard hot and cold water faucet. U.S Pat. No. 2,200,503 Judell et al, describes a spray head of improved construction. U.S. Pat. No. 3,882,864 Montgomery, describes a flow controlled spray handle on an extensible hose. U.S Design Pat. Nos. 245,093, and 281,114 show arrangements of extendible spray heads together with standard sink faucets. The prior art does not disclose a spray head incorporating a water flow operated vibrating massage spray head.

SUMMARY OF THE INVENTION

It is the primary objective of the present invention to provide an extendible flexible hose coupled hand held vibrating spray/massage device incorporating a finger operated valve to control the rate of flow of water through the spray/massage device. The standard hot and cold water mixer means on the water faucet adjusts the temperature of the water in the spray/massage head.

The spray/massage head fixture incorporates a water driven turbine wheel coupled to the slidable portion spray/massage face spray head by means of a crankshaft. Rotation of the turbine wheel drives the spray/-massage face back and forwards providing the vibrational massage feature of the present invention. The face of the spray/massage device having a few extended spray nozzles surrounded by a plurality of small spray orifices arranged to confine the spray to a small area of the scalp or skin thus preventing over-spray to surrounding areas. In operation the spray/massage device massages the scalp or skin while simultaneously spraying temperature controlled water through the spray face.

DETAILED DESCRIPTION OF THE PREFERRED EMBODIMENT

Figure 1:
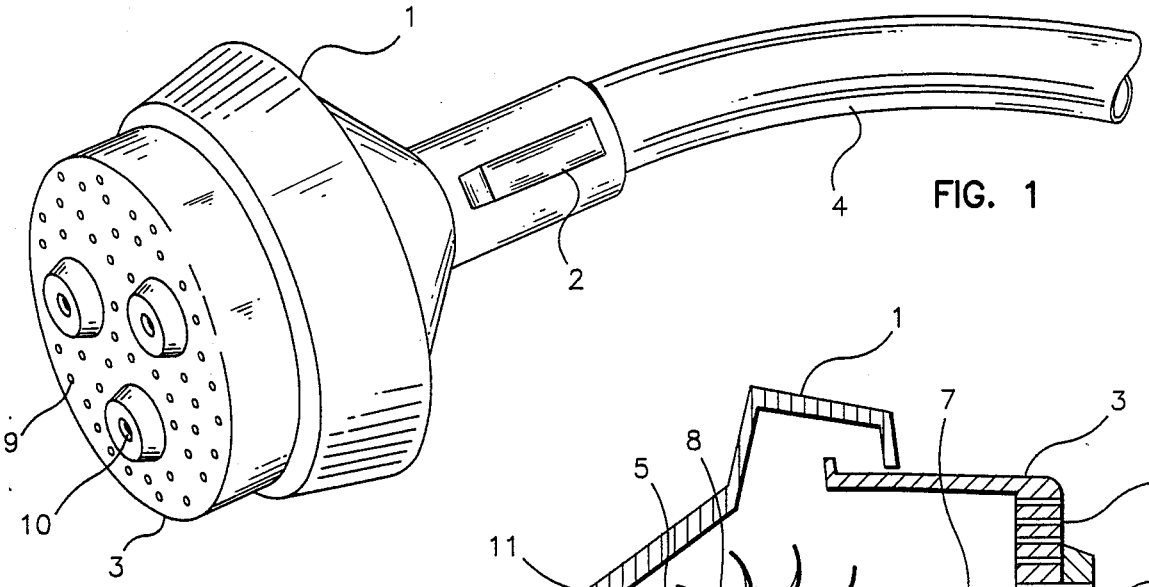
FIG. 1 is a right front perspective view of the spray/-massage fixture.

The spray/massage fixture 1 is shown in FIG. 1 attached to flexible hose 4. The finger operated valve 2 regulates the flow of water through the spray/massage fixture. The face of the vibratory portion 3 of the spray/massage fixture 1 is shown with the water spray orifices 9 and 10.

Figure 2:
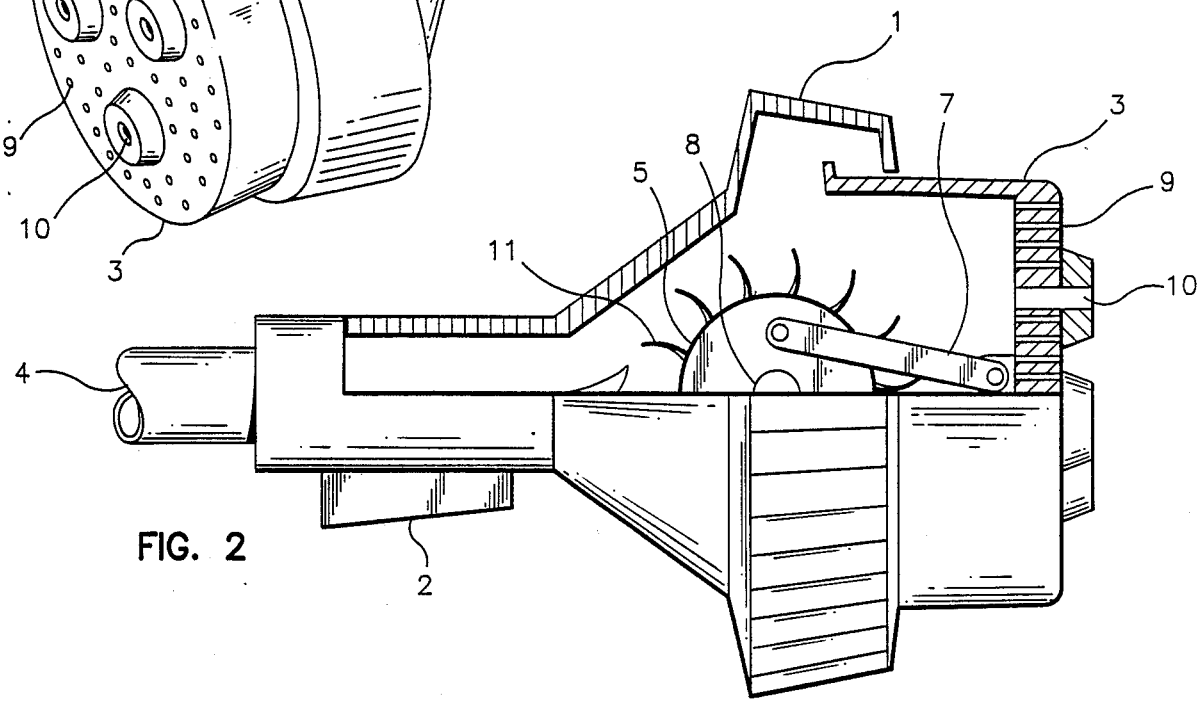
FIG. 2 is a partially sectioned side view of the spray/-massage fixture.

In FIG. 2 the side of the fixture 1 is partially sectioned to show the turbine wheel 5 with turbine blades 11 rotatable around the horizontal shaft 8. The crankshaft 7 driven by the turbine wheel 5 moves the vibratory portion 3 in and out of the fixture 1.

Figure 3:
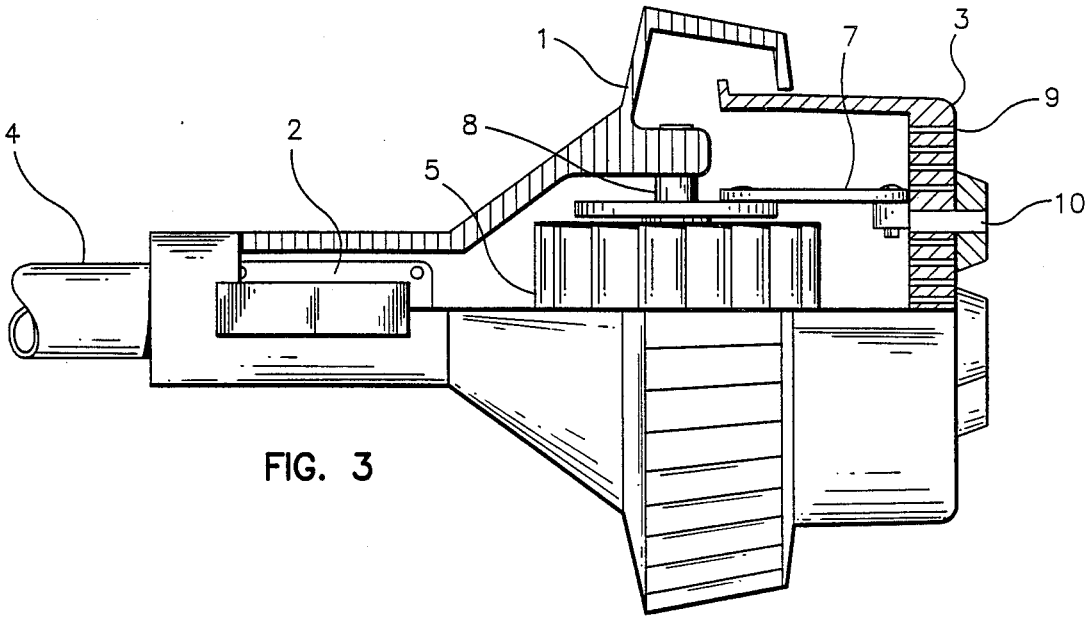
FIG. 3 is a partially sectioned bottom view of the spray/massage fixture.

FIG. 3 is a bottom view of the spray/massage fixture 1 showing the finger operated water valve 2, the water turbine 5 with blades 11 and crankshaft 7 driving face portion 3. Water spray orifices 9 and 10 are shown in the face portion 3.

I claim:

1. A hand held water spray fixture adapted to be coupled to a standard sink water faucet by a flexible hose wherein the improvement comprises:

a. the spray fixture having a vibratory face with water exiting orifices;

b. the vibratory face having an in and out vibratory movement;

c. the spray fixture incorporating an enclosed turbine wheel driven by the water flow though the spray fixture;

d. a crankshaft coupling the turbine wheel to the movable vibratory face; and, e. the vibratory face having at least one protuding water nozzle surrounded by a plurality of small orifices for passage of water for forming the controlled spray pattern.

* * * * *